US005289782A

United States Patent [19]

Rizzi et al.

[11] Patent Number: 5,289,782

[45] Date of Patent: Mar. 1, 1994

[54] ADJUSTABLE HEIGHT TABLE

[75] Inventors: John J. Rizzi, Weston, Conn.; Joseph J. Smith, II, Hereford Township, Berks County; Howard P. Greene, Jr., Schwenksville, both of Pa.

[73] Assignee: Westinghouse Electric Corp., Pittsburgh, Pa.

[21] Appl. No.: 801,981

[22] Filed: Dec. 3, 1991

[51] Int. Cl.[5] ..... A47B 9/00

[52] U.S. Cl. ..... 108/147; 108/146; 248/162.1

[58] Field of Search ..... 108/147, 144, 146, 136, 108/96; 248/188.5, 188.1, 162.1, 405; 74/96; 192/141, 138; 240/406.1, 406.2

[56] References Cited

U.S. PATENT DOCUMENTS

| | | | |
|---|---|---|---|
| 660,868 | 10/1900 | Reid | 108/136 X |
| 3,314,384 | 4/1967 | Mann et al. | 108/146 |
| 3,989,211 | 1/1976 | Gundlach | 248/162.1 |
| 4,351,245 | 9/1982 | Laporte | 108/144 X |
| 4,557,450 | 12/1985 | Bruneau | 108/146 X |
| 4,627,591 | 12/1986 | Heckmann | 248/188.5 X |
| 4,922,836 | 5/1990 | Damico | 108/144 |
| 4,981,085 | 1/1991 | Watt | 248/162.1 X |

FOREIGN PATENT DOCUMENTS

| | | | |
|---|---|---|---|
| 2818016 | 11/1979 | Fed. Rep. of Germany | 108/144 |
| 2436087 | 5/1980 | France | 108/136 |

*Primary Examiner*—Jose V. Chen

*Attorney, Agent, or Firm*—Carla J. Vrsansky

[57] ABSTRACT

An adjustable height table having a top that can be vertically adjusted to various heights by a pair of telescoping legs and a counterbalance weight mechanism which includes a weight box and weights that can be easily added or removed by the user depending on the weight carried by the table top. A locking mechanism including a spring-urged threaded half nut and a stationary threaded rod enables the table top to be locked in place once a desired height is achieved.

16 Claims, 6 Drawing Sheets

ADJUSTABLE HEIGHT TABLE

BACKGROUND OF THE INVENTION

1. Field of the Invention

This invention relates to an adjustable height table and, more particularly to an adjustable height table having an improved counterbalance mechanism including a plurality of different weights that provide an infinite range of uniform counterbalance capability so that the height of the table top can be easily adjusted, no matter what load is being carried by the table top.

2. Description of the Related Art

Modern office or industrial environments provide work stations having various types of functional furniture components. These furniture components include work surfaces and table tops utilized for various purposes, from drafting to clerical and word processing functions. These surfaces therefore must be able to support a variety of equipment such as typewriters and computer terminals, while at the same time be able to be vertically adjusted to accommodate a variety of tasks and a variety of users easily and effortlessly.

Tables having adjustable height table tops are widely known in the art. Many of these tables employ the use of telescoping legs and counterbalance mechanisms. These counterbalance mechanisms include a counterbalance spring or springs as disclosed in U.S. Pat. Nos. 3,140,559, 4,559,879, and 4,981,085. Other means of adjusting the height of table tops include pulley and cable mechanisms as disclosed in U.S. Pat. Nos. 4,559,879, 4,619,208, and 4,981,085.

Adjustable height tables are also known in the art to employ latch mechanisms which can include latch arms and push-pull cables as disclosed in U.S. Pat. No. 4,981,085. However, no adjustable height tables are known to easily and cost effectively employ a means of adjusting the height in an infinite number of positions by counterbalancing the myriad of loads that can be carried by the table tops, while at the same time providing a locking means to lock the height of the table top in a desired position and providing a means of easily and uniformly lifting the table top while preventing racking and obviating the need to disturb any item that may be on the table top, such as computer terminals or other heavy equipment.

Consequently, there exists a need to provide an adjustable height table that may be easily adjusted uniformly without disturbing the items that are on the table, while preventing racking and providing for a versatile means of counterbalancing the load carried by the table top that may be easily performed quickly and efficiently on location.

SUMMARY OF THE INVENTION

In accordance with the present invention, the foregoing deficiencies of prior art are obviated by providing an adjustable height table comprising a table top, telescoping legs, a counterbalance weight means located below the table top and between each leg and locking means. Each telescoping leg includes a stationary portion and a movable portion. The table top which is attached to the movable portion of each leg is able to move and therefore be adjusted vertically in any number of desired positions. The counterbalance weight means includes a weight box and a plurality of counterbalance weights that may be easily added or removed to counterbalance the load carried by the table top without disturbing the items that are on the table top. The weight box and the associated counterbalance weights are located between the stationary portions of the legs and move along a channel in each leg with the aid of cables, pulleys and a rack and pinion, which prevents racking of the table top. Finally, the locking means includes at least one vertically disposed threaded rod and a threaded half nut assembly which engage to lock the table in a desired position.

BRIEF DESCRIPTION OF THE DRAWINGS

While the specification concludes with the claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention herein described provides an adjustable height table including a locking mechanism and a counterbalance mechanism having a plurality of weights which uniformly counterbalance any load that may be carried on the table while preventing racking, thereby enabling the table top to be adjusted to any height to accommodate any user with minimal effort.

Figure 1:
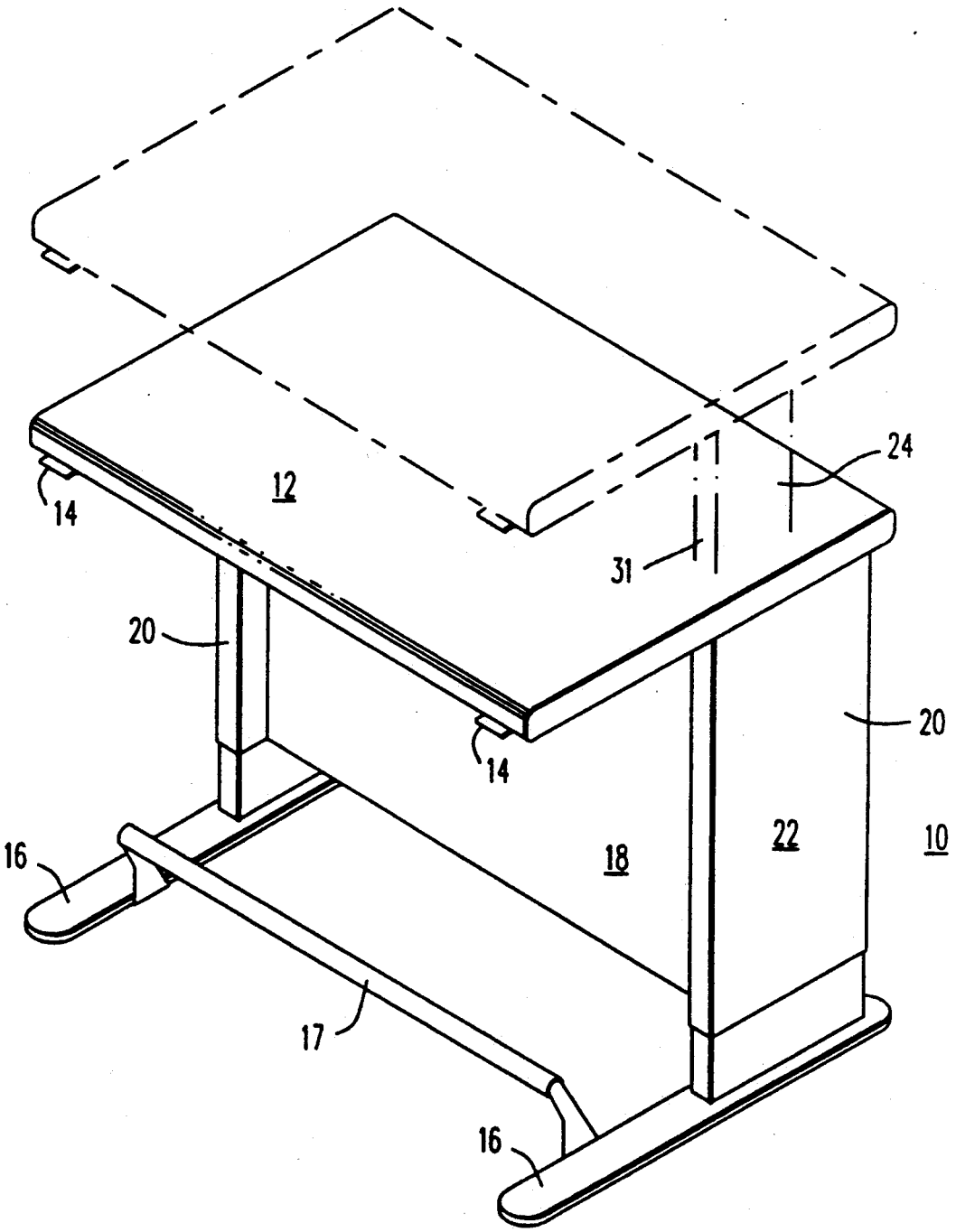
FIG. 1 is a perspective view of the adjustable height table with the table top illustrated in its raised position in phantom.

Referring now in detail to the drawings wherein like reference characters represent like parts throughout the several views, there is illustrated in FIG. 1 an adjustable height table 10 which includes a table top 12, an actuator or handle 14, two telescoping legs 20, feet 16 and a footrest 17. A removable modesty panel 18 covers the middle section of the table between the two legs 20, where the counterbalance mechanism is located. The counterbalance mechanism, which is disposed between the two legs 20, will be described presently.

Each telescoping leg 20 includes a stationary portion 22 and a movable portion 24. The movable portion 24 is shown in FIG. 1 in phantom, along with the table top 12 in a raised position. The underside of the table top 12 is mounted by screws, not shown, to two cantilever arms 25, one on each side, which are horizontal tubular structures and which are also mounted along the top of each movable portion 24 of each leg 20.

Figure 2:
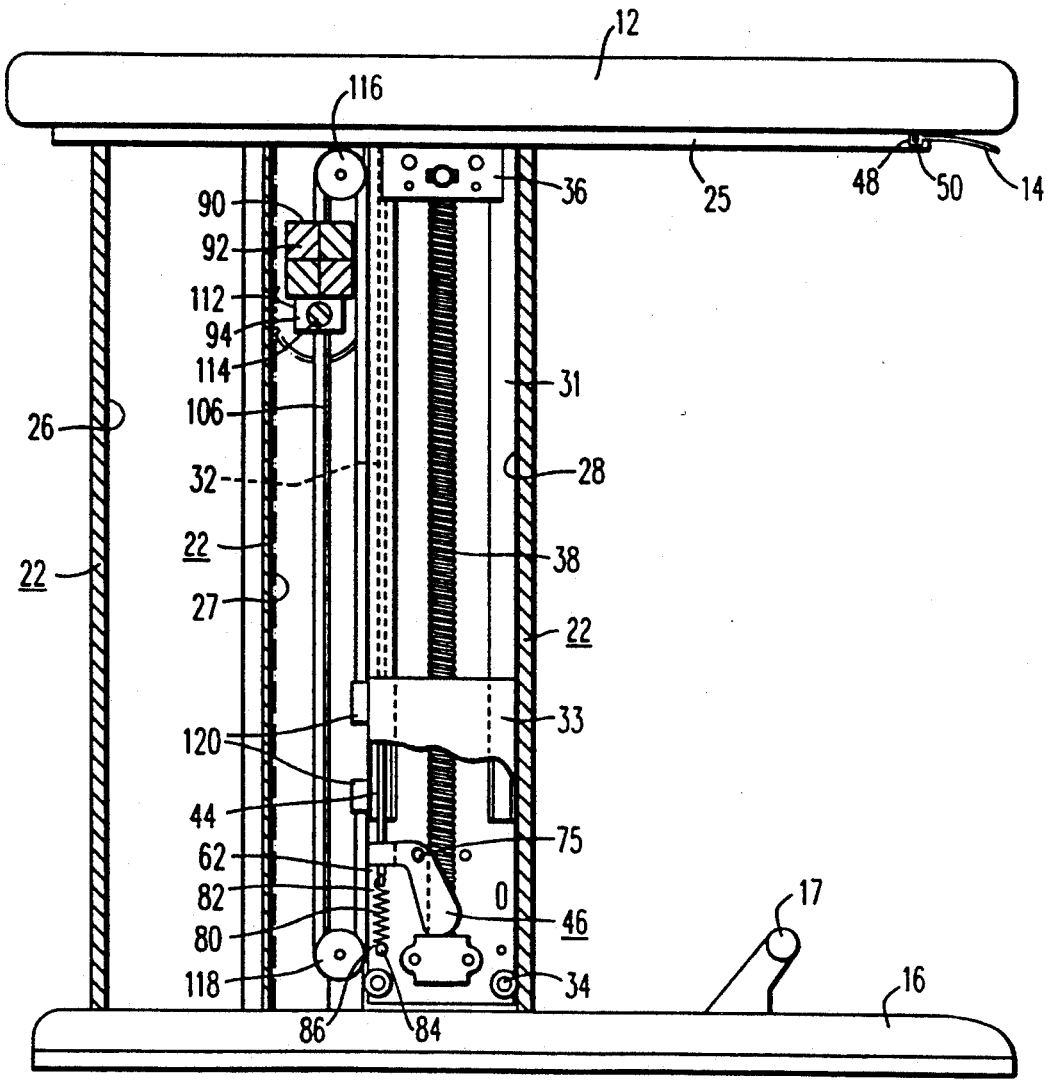
FIG. 2 is a side elevation view of the adjustable height table with the cover of the leg removed.
Figure 3:
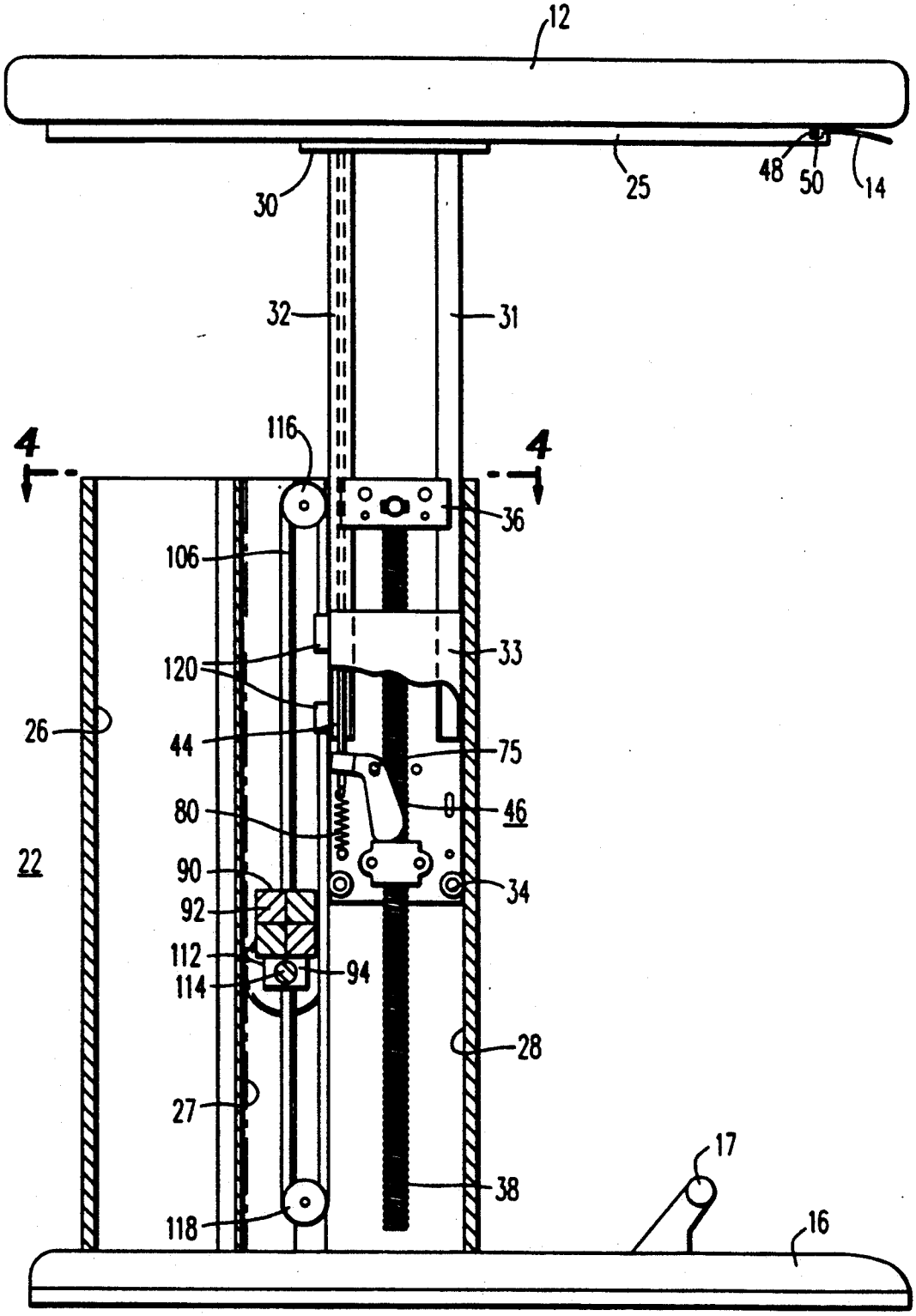
FIG. 3 is a side elevation view of the adjustable height table, similar to FIG. 2, illustrating the table top in a raised position with the counterbalance weight means in a lowered position.
Figure 4:
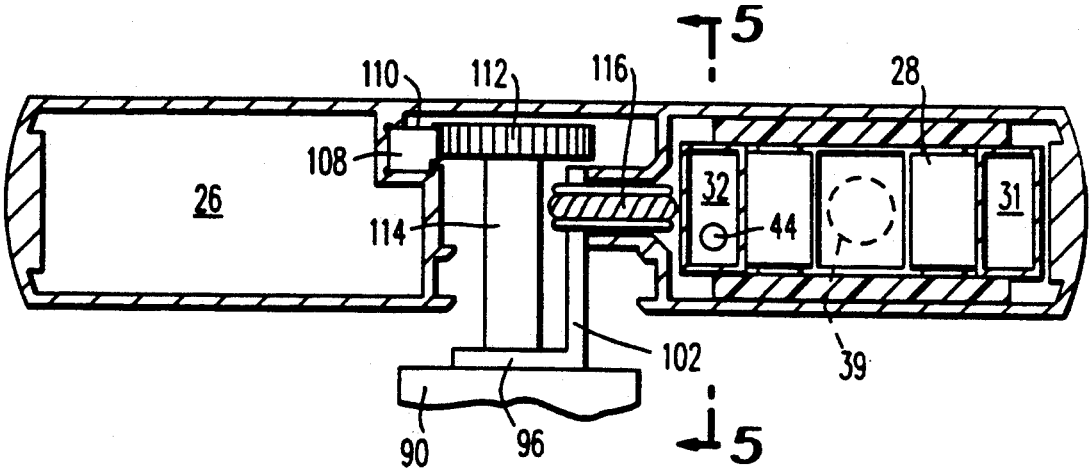
FIG. 4 is a sectional view taken along the line 4—4 of FIG. 3 illustrating the various channels of the stationary portion of the leg along with the rack and pinion mechanism.

Referring now to FIGS. 2 and 3 and the sectional view of FIG. 4, the stationary portion 22 of the leg 20 includes three channels, two outer channels 26 and 28 and an inner channel 27. Outer channel 28 houses the movable portion 24 of the leg 20 and the locking mechanism. The inner channel 27, which is disposed between the two outer channels 26 and 28, houses the counterbalance mechanism.

Still referring to FIGS. 2 and 3, the movable portion 24 of the leg 20 includes a horizontal top plate 30 which attaches to the underside of each cantilever arm 25, and two tubular sides 31 and 32, one of which houses part of the locking mechanism. The movable portion 24 of the leg 20 includes locking mechanism cover plates 33 on each side thereof which are welded to the side edges of the tubular sides 31 and 32. The top 30, sides 31 and 32 and the cover plates 33 of the movable portion 24 form a movable carriage mounted to each cantilever arm 25 on which the table top 12 travels as the table height is adjusted vertically. The cover plates 33, one of which is shown partially cut away in FIGS. 2 and 3, house the remainder of the locking mechanism and one roller assembly 34. The other roller assembly 36, located closer to the top plate 30, is contained between the two tubular sides 31 and 32 and attached by screws (not shown) to the housing defining the outer channel 28 of the stationary portion 22 of each leg 20. The roller assemblies 34 and 36 aid in the upward and downward movement of the movable portion 24 as the height of the table top 12 is adjusted.

The locking mechanism which is housed inside the outer channel 28 of the stationary portion 22 of each leg 20 will now be described in detail. Still referring to FIGS. 2 and 3, each locking mechanism includes a threaded rod 38 which is vertically disposed between the two tubular sides 31 and 32 of the movable portion 24 of each leg 20. The top 39 of the threaded rod 38 is permanently affixed to a weld nut 40 which is encased in the upper roller assembly 36. The threaded rod 38 is suspended between the two tubular sides 31 and 32 of the movable portion 24 and remains stationary because the upper roller assembly 36 to which it is attached remains stationary as the upper roller assembly 36 is attached to the housing surrounding the outer channel 28, as was previously mentioned.

Figure 6:
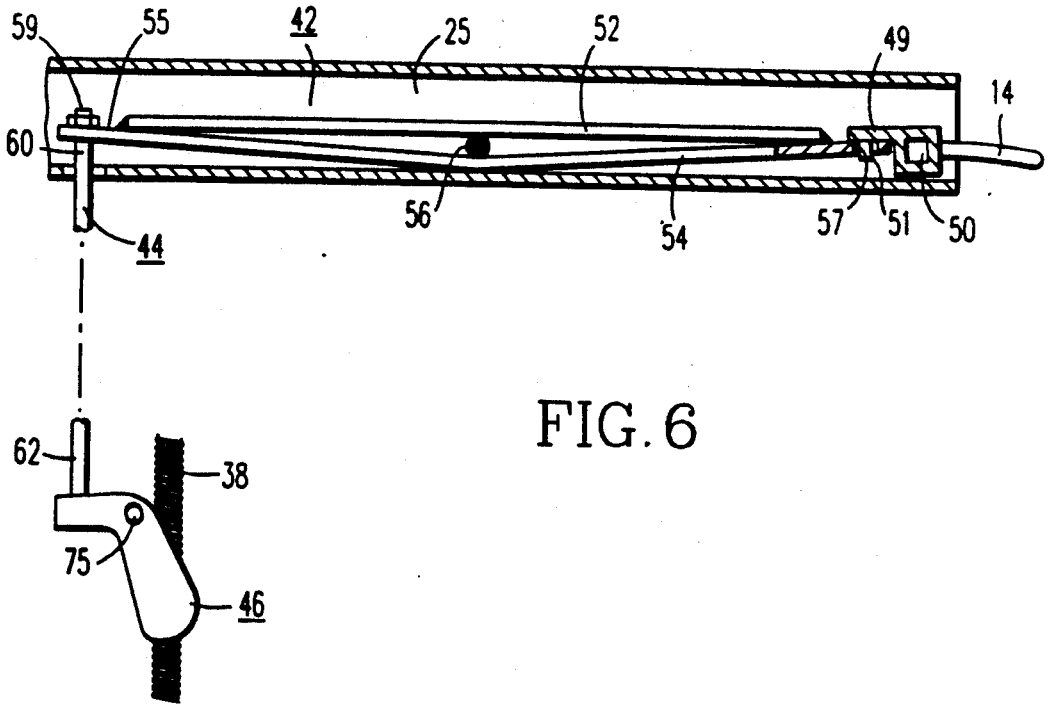
FIGS. 6 and 7 are schematic views illustrating the operation of the locking mechanism.
Figure 7:
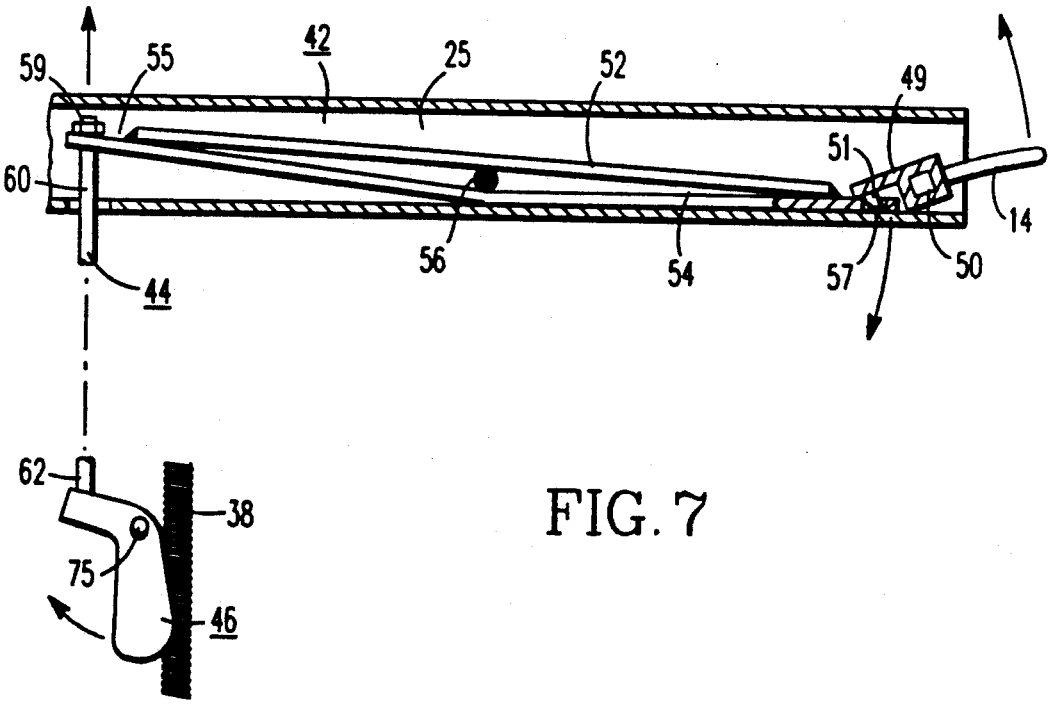
Figure 8:
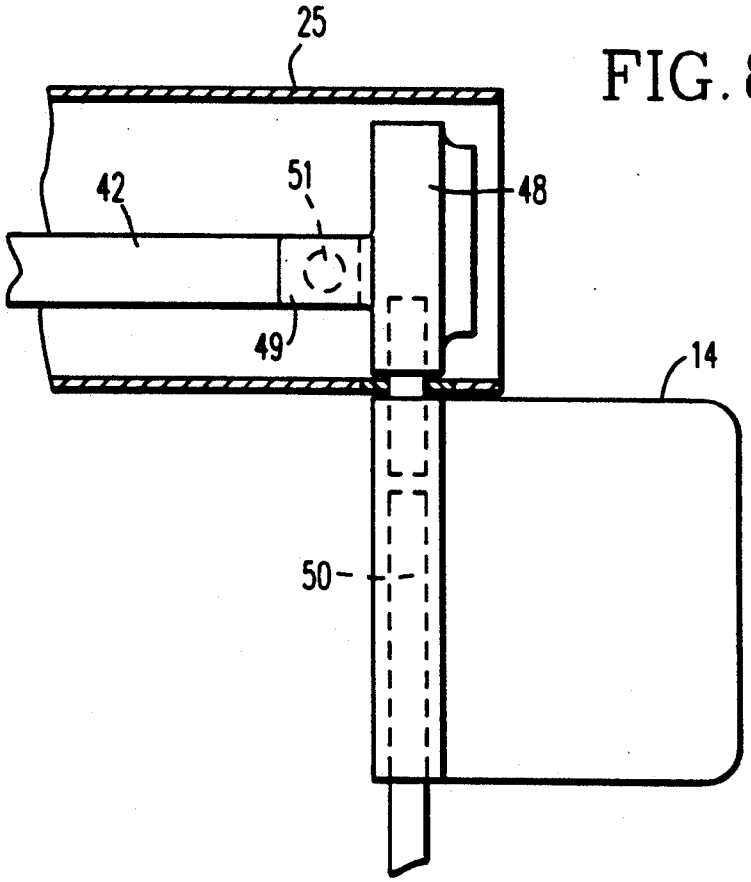
FIG. 8 is a top plan view of the handle and the pivot bar.

Each locking mechanism also has locking means which includes the handle 14, a pivot bar 42, an actuating rod 44 and a threaded half nut assembly 46. The handle 14 coacts with the pivot bar 42 by way of an actuator lever 48 which has a small, lateral extension 49 and a dependent pin 51. The handle 14 is connected to the actuator lever 48 by a thin, square rod 50, which is more clearly illustrated in FIG. 8 and extends the length of the table top 12 and terminates in the other handle 14 and actuator lever 48. The pivot bar 42, which is more fully illustrated in FIGS. 6 and 7, is completely housed inside the cantilever arm 25 and is comprised of two thin bars, a straight bar 52 and a bowed bar 54 which are welded together on both ends 53 and 55 as well as in the middle to create a pivot point 56 at which the pivot bar 42 rocks inside the cantilever arm 25 when actuated.

End 53 which coacts with the handle 14 by way of the actuator lever 48 contains a small opening 57 into which the pin 51 extends. The other end 55 coacts with the actuating rod 44. End 55 also contains an elongated opening 58 through which one end of the actuating rod 44 extends and is held loosely to end 55 of the pivot bar 42 by a thin washer nut 59. The actuating rod 44 includes two ends, a second end 60 which coacts with opening 58 of end 55 and a first end 62 which is connected to the threaded half nut assembly 46.

Figure 9:
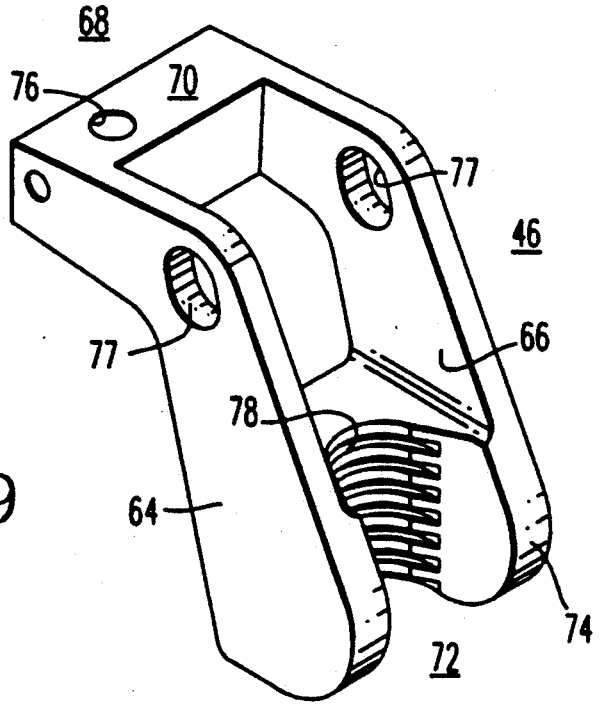
FIG. 9 is a perspective view of the threaded half nut of the locking mechanism.

The threaded half nut assembly 46, which is most clearly illustrated in FIG. 9, resembles a saddle shape and includes two sides 64 and 66 connected at the top end 68 by a square portion 70 and at the bottom end 72 by a C-shaped half nut 74. The threaded half nut assembly 46 is mounted to the cover plates 33 for movement into and out of engagement with the threaded rod 38 by pivot pin 75 through elliptical apertures 77. This interaction between the pivot pin 75 and the elliptical apertures 77 allows the threaded half nut assembly 46 to remain engaged with the threaded rod 38, thereby locking the table in a desired position and preventing slippage even when vertical pressure is applied to the table top absent actuation of the handle 14.

The square portion 70 includes an aperture 76 through which the first end 62 of the actuating rod 44 is secured. The C-shaped half nut 74 includes square threads 78 which engage with the threaded rod 38. The use of square threads 78 in the half nut 74 provides better load distribution and also more effectively holds the weight carried by the table top 12 while at the same time engages the table in a locked position. Referring back to FIGS. 2 and 3, the first end 62 of the actuating rod 44 terminates by way of a bias spring 80, the top hook end 82 of which is connected to the first end 62 of the actuating rod 44 and the other hook end 84 of which is connected to a small pin 86 disposed between and welded to the two cover plates 33 of the movable portion 24 of the leg 20.

The counterbalance mechanism, which is comprised of weight means, will now be fully described. As previously mentioned, the counterbalance mechanism is disposed between the two stationary portions 22 of the legs 20 and concealed from view by a removable modesty panel 18. In particular, the counterbalance mechanism is located and partially housed in and between the inner channels 27 of the stationary portions 22 of the legs 20. The counterbalance mechanism comprises weight means which includes a long, rectangular weight box 90 and a plurality of weights 92. The weight box 90 is easily accessible simply by removing the modesty panel 18 which conceals it whereby weights 92 may be added or removed to counterbalance the load carried by the table top 12. The weight box 90 is supported by and connected to a pair of ballast brackets 94. Each ballast bracket 94 is "L" shaped, with one edge, the shorter edge 96, containing three openings, two small openings 98 and one large opening 100. The other edge, the longer edge 102, contains two hook extensions 104 through which cables 106 are secured.

Figure 5:
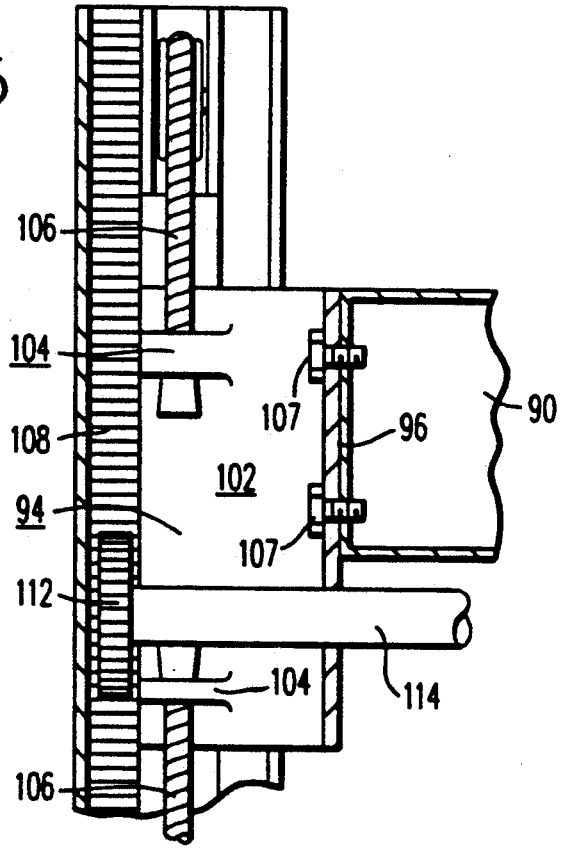
FIG. 5 is a sectional view taken along line 5—5 of FIG. 4.

The ballast brackets 94 glide along the sides of the inner channels 27 which are closest to the outer channels 28, see FIGS. 4 and 5. Each end of the weight box 90 is attached to the shorter edge 96 of the ballast bracket by way of screws 108 which pass through the small openings 98 of the ballast bracket 94 and into the weight box 90. The weight box is therefore supported on either end, between the two inner channels 27 of the stationary portions 22 of the legs 20, by each shorter edge 96 of each ballast bracket 94.

The weight means has associated therewith a rack and pinion means which includes a pair of racks 108, which are contained in each inner most groove 110 of each inner channel 27, and a pair of spur gears 112, which are interconnected to each other by an axle 114.

Each gear 112 engages with one of the racks 108. The axle 114 is positioned through each large opening 100 in each ballast bracket 94 so that the axle 114 travels in conjunction with the weight box 90.

The counterbalance means further includes a pair of pulleys in each inner channel 27 of each leg 20, a top pulley 116 located at the top of each inner channel 27 and a bottom pulley 118 located at the bottom of each inner channel 27. A pair of cables 106 are attached at one end to hook brackets 120 located on each tubular side 32 of each movable portion 24 and extend through the pulleys, one cable 106 through the top pulley 116 and one cable 106 through the bottom pulley 118. The cables 106 are then connected to the hook extensions 104 located on each ballast bracket 94. The effect of this pulley-cable association is to form a large "loop" or cycle for movement, starting with one end of each cable attached to the movable portion 24 by way of hook brackets 120, continuing through the top 116 and bottom 118 pulleys and terminating upon attachment to the ballast brackets 94 by way of the hook extensions 104. For example, as the movable portion 24 of the leg 20 moves upward, the weight box, by aid of the ballast brackets 94 and pulleys 116 and 118, moves downwardly.

The operation of the adjustable height table will now be discussed. In order for the user to adjust the height of the table top 12, the user simply lifts up on either or both of the handles 14. This upward motion by either or both of the handles 14 in turn causes the actuator lever 48 on each end to pivot downwardly, see FIG. 7, whereby the one end 53 of each pivot bar 42 which coacts with the actuator lever 48 by way of the lateral extension 49 and dependent pin 51, pivots downwardly. This motion causes each pivot bar 42 to pivot inside the cantilever arm 25 about pivot point 56 located in the middle of the pivot bar 42 causing the other end 55 of the pivot bar 42 to move upwardly. This upward movement of end 55 of the pivot bar 42 causes the second end 60 of the actuating rod, which is loosely mounted in the elongated opening 58 of the end 55 of the pivot bar 42, to move upwardly, thereby causing the threaded half nut assembly 46 to swing away and disengage from the threaded rod 38 in opposition to the locking force provided by the bias spring 80, thereby unlocking the table 10 from a locked position so that the table top 12 may be raised or lowered by the user to a desired position. It should be mentioned that the locking mechanism is located and the above-described action occurs simultaneously in both of the legs 20. Since both handles 14 are connected by a thin square rod 50, each handle 14 will move simultaneously when one or both handles 14 are actuated.

Once the table is in an unlocked position the user, while still depressing either or both of the handles 14, simply lifts up or pushes down on the table top 12. The movable portion 24 of the leg 20, which is attached to the underside of the cantilever arm 25, the top of which is attached to the underside of the table top 12 as previously mentioned, begins to move in the direction selected since each locking mechanism in each leg 20 is now disengaged. The roller assemblies 34 and 36 aid in the fluid motion of the movable portions 24 of the legs 20. As the movable portions 24 move, see FIG. 3, the cables 106 connected to the movable portions 24 by way of hook brackets 120, move through the pulleys 116 and 118 thereby causing the weight box 90 to move in the opposite direction from the table top 12 thereby counterbalancing the force on the table top 12. The ballast brackets 94 to which the weight box 90 is attached slide along the inner channels 27 of the stationary portions 22 of the legs 20 as the weight box 90 moves. The spur gears 112 aid in movement of the weight box 90 as the gears 112 are interconnected to each other by way of the axle 114. The gears 112 engage in the racks 108 located in both innermost grooves 110 of the inner channels 27 of each leg 20 simultaneously, thereby preventing racking of the weight box 90 as the table top is being positioned, as well as creating a more controlled and uniform motion of the weight box 90 and ballast bracket 94 assembly. When the desired position of the table top 12 is achieved, the user releases the handles 14 which cause the pivot bars 42 to pivot in the opposite direction inside the cantilever arms 25 as earlier described, which in turn cause the actuating rods 44 to shift downward, causing the bias springs 80 attached to the first end 62 of each actuating rod 44 to bias the threaded half nut assemblies 46 back into engagement with the threaded rods 38, thereby locking the table top in the new position. Thus, the user may easily adjust the height of the table to any desired position without having to first remove any of the equipment, such as computer terminals, from the table top.

As will be apparent from the foregoing, the adjustable height table of this invention employs a counterbalance weight means for easily and cost effectively adjusting the height of the table top in an infinite number of positions by counterbalancing the myriad of loads that can be carried by the table top, while at the same time providing a locking means to lock the height of the table top in a desired position. The adjustable counterbalance system provides a means of easily and uniformly lifting the table top while preventing racking and obviates the need to disturb any item that may be on the table top, such as computer terminals or other heavy equipment.

We claim:

1. An adjustable height table comprising:

a table top;

a pair of telescoping legs connected to said table top; and a counterbalance mechanism comprising weight means, said weight means including a rectangular weight box and a plurality of removable weights, wherein said weight box is disposed between and attached to said pair of telescoping legs, one end of said weight box attached to one of said legs, and the other end of said weight box attached to the other of said legs.

2. An adjustable height table according to claim 1 wherein said telescoping legs include a stationary portion and a movable portion, said table top connected to said movable portion.

3. An adjustable height table according to claim 2 wherein said weight box is supported by a pair of ballast brackets slidably mounted to said legs, each of said ballast brackets including means for accepting at least one cable, said cable having two ends, one end which is associated with said ballast bracket, and the other end which extends through a pulley connected to said stationary portion of said leg.

4. An adjustable height table according to claim 3 wherein said weight means has associated therewith a rack and pinion means, said rack and pinion mans including a pair of racks, one of said racks being associated with one of said telescoping legs, and a pair of gears, said gears being interconnected with each other and associated with said racks for smooth height adjustment of said table.

5. An adjustable height table comprising:

a table top;

a pair of telescoping legs connected to said table top;

a threaded rod vertically disposed in at least one of said legs; and a threaded locking means disposed in said at least one leg and arranged to engage said threaded rod for locking said table at a predetermined height, said locking means including a spring-urged, threaded half nut for locking engagement with said threaded rod.

6. An adjustable height table according to claim 5 wherein said locking means further includes an actuating rod and a pivot bar, said pivot bar including two thin bars welded together and having a first end, a second end and a central weld, said actuating rod having two ends, a first end which is associated with said threaded half nut and a second end which coacts with said first end of said pivot bar.

7. An adjustable height table according to claim 6 wherein a cantilever arm is disposed between said table top and said telescoping leg, said pivot bar being housed inside and pivotally supported by said cantilever arm bars, one bar being straight, the other bar being bowed.

8. An adjustable height table according to claim 7 wherein said second end of said pivot bar coacts with an actuator, said actuator comprising a handle for disengaging said locking means whereby said table may be vertically adjusted.

9. An adjustable height table comprising:

a table top;

a pair of telescoping legs, each including a stationary portion and a movable portion, and a pair of cantilever arms, said table top connected through said cantilever arms to said movable portions;

a counterbalance mechanism comprising weight means, said weight means including a rectangular weight box disposed between and attached to said stationary portions of said pair of telescoping legs and a plurality of removable weights; and locking means including a threaded rod vertically disposed in at least one of said telescoping legs and a threaded half nut also disposed in said at least one telescoping leg, said threaded half nut arranged to engage said threaded rod for locking said table at a predetermined height.

10. An adjustable height table according to claim 9 wherein said weight box is supported by a pair of ballast brackets slidably mounted to said stationary portions of said legs, said ballast brackets including means for accepting at least one cable, said at least one cable having two ends, one end coacting with said ballast bracket and the other end extending through a pulley connected to said stationary portion of said leg.

11. An adjustable height table according to claim 10 wherein said weight means further includes a rack and pinion means, said rack and pinion means including a pair of racks, one of said racks being associated with each of said telescoping legs, and a pair of gears, said gears being interconnected with each other and associated with said racks.

12. An adjustable height table according to claim 11 wherein said threaded rod of said locking means is stationary, whereas said threaded half nut is spring urged and capable of engaging and disengaging with said threaded rod.

13. An adjustable height table according to claim 12 wherein said locking means further includes an actuating rod and a pivot bar, said pivot bar including two thin bars, one bowed bar and one straight bar welded together and having a central weld, said actuating rod having two ends, a first end which is attached to said threaded half nut and a second end which coacts with said pivot bar.

14. An adjustable height table according to claim 13 wherein said pivot bar is disposed inside and pivotally supported by said cantilever arm.

15. An adjustable height table according to claim 14 wherein said pivot bar further includes two ends, a first end coacting with said second end of said actuating rod, and a second end coacting with an actuator.

16. An adjustable height table according to claim 15 wherein said actuator includes a handle, whereby when said handle is moved to a first position said pivot bar pivots inside said cantilever arm about said central weld thereby causing said actuating rod to move in a direction which causes said threaded half nut to become disengaged from said threaded rod.

* * * * *